US005833153A

United States Patent [19]

Ackers et al.

[11] Patent Number: 5,833,153

[45] Date of Patent: Nov. 10, 1998

[54] ROTOR ASSEMBLY FOR HORIZONTAL IMPACT CRUSHER

[75] Inventors: Stephen B. Ackers, deceased, late of Columbia, S.C., by Jennifer Ackers, legal representative; Donley D. Freshwater, Columbia, S.C.

[73] Assignee: W. S. Tyler, Incorporated, Columbia, S.C.

[21] Appl. No.: 611,941

[22] Filed: Mar. 6, 1996

[51] Int. Cl.[6] ..... B02C 13/26

[52] U.S. Cl. ..... 241/192; 241/294

[58] Field of Search ..... 241/189.1, 192, 241/294, 191

[56] References Cited

U.S. PATENT DOCUMENTS

| | | | |
|---|---|---|---|
| 3,645,459 | 2/1972 | Lucas et al. | 241/191 |
| 4,679,740 | 7/1987 | Orphall . | |
| 4,821,970 | 4/1989 | Puetz . | |
| 5,092,529 | 3/1992 | Bechler et al. . | |
| 5,529,249 | 6/1996 | Braun et al. | 241/191 |

FOREIGN PATENT DOCUMENTS

| | | | |
|---|---|---|---|
| 143643 | 3/1961 | U.S.S.R. | 241/191 |

*Primary Examiner*—Mark Rosenbaum
*Attorney, Agent, or Firm*—Donald L. Beeson

[57] ABSTRACT

An improved rotor assembly for a horizontal impact crusher has segmented blow bars in a continuous wedge structure which overlaps the blow bar segment joints to structurally tie the blow bar segments together. Backer face plates are also provided to accommodate blow bars of different thicknesses within the same wedge slot.

17 Claims, 4 Drawing Sheets

ROTOR ASSEMBLY FOR HORIZONTAL IMPACT CRUSHER

BACKGROUND OF THE INVENTION

The present invention generally relates to crushing machines for materials benefication, and more particularly to horizontal impact crushers having a rotor assembly with replaceable blow bars.

Horizontal impact crushing machines are well-known in the art and have been in use for many years. Such machines utilize the "blow bars" (sometimes called "breakers" or "impact" bars) which project from the periphery of the body of a rotor assembly rotating at high speeds to propel crushable material fed into the machine against hardened surfaces, called "curtains," such that, the impact forces of the material striking the hardened surfaces cause the material to break up into smaller pieces. The machine's blow bars experience considerable wear due to the tremendous impact forces encountered during normal operating conditions, and therefore must be periodically replaced. To facilitate replacement and to reduce inventory requirements for spare blow bar parts, a number of current impact crusher designs provide for segmented blow bars, that is, shorter blow bar lengths that may require two or more blow bar segments installed end-to-end to span the length of the rotor bar body. The shorter blow bar segments are easier to remove than one large blow bar that extends the entire length of the rotor body. At the same time, blow bar segments of a single, uniform size can be carried in inventory for use with different sized machines and rotor assemblies.

One known method of replaceably mounting blow bars to a horizontal impact crusher rotor assembly is to use a wedge seating arrangement wherein the blow bars are caused to wedge in place against wedge surfaces associated with the body of the rotor assembly by centrifugal forces exerted on the blow bars as they rotate at high speeds. One such wedge seating arrangement is described in U.S. Pat. No. 4,679,740 issued to Axel O. Orphall wherein the blow bars are held in wedge slots formed in the perimeter of a series of disk plates radially extending from the rotor shaft, so that the blow bars are gripped only at discreet wedge locations. Such a wedge seating arrangement, however, cannot readily accommodate the advantageous use of segmented blow bars due to the limited area of contact between the blow bars and the disc plate wedges and due to the lack of structural integrity that would result from such an assembled unit. The point contacts also lead to increased stress on the blow bars and rotor assembly resulting in excessive wear and blow bar breakage and increased down time replacement costs.

Another disadvantage with existing blow bar mounting arrangements is the inability of the mounting slots to accommodate blow bars having different thicknesses. Also, wear on the backer wall structure of the mounting slots typically requires that the backer wall structure be periodically machined or rebuilt. Machining operations are costly and time-consuming and the need for different sized wedges increases inventory costs.

The present invention provides an improved rotor assembly for a horizontal impact crusher which provides the advantage of a wedge type mounting system for the blow bars while overcoming the aforementioned disadvantages of existing wedge mounting systems. The present invention also provides a means for wedge mounting segmented blow bars to the rotor body while providing a structurally sound wedge system that will hold up to the rugged operating environment of the rotor assembly. Further provided is a means for mounting blow bars of different thicknesses with the same wedge mounting system, as well as a means for eliminating the need to periodically machine or rebuild the wedge slot's backer wall structure.

SUMMARY OF THE INVENTION

The invention is an improved rotor assembly comprised of a rotor body having an outer perimeter and at least two wedge slots in the perimeter of the rotor body parallel to the rotor's axis. Each wedge slot is a continuous wedge slot which preferably extends from one end of the rotor body to the other and which has a defined width, a wedge seat sloping inwardly in relation to the rotor's perimeter, and a backer wall opposed to the wedge seat. A segmented floating blow bar is removably inserted into each wedge slot between the slot's wedge seat and its backer wall structure. Floating wedge means are, in turn, inserted between the blow bar and the slot's wedge seat such that the blow bar is wedged in place by centrifugal forces imparted to the blow bar and wedge structure during high speed rotation of the rotor assembly. The floating wedge means provides a continuous wedge structure which overlaps the joint or joints formed between blow bar segments so as to structurally tie the blow bar segments together. The blow bar wedge means can also be segmented in such a manner that the joints between segmented wedge elements are displaced relative to the blow bar segment joints.

In another aspect of the invention, a backer face plate is provided on the side of the blow bar opposite the blow bar wedge means, that is, between the blow bar and the wedge slot's backer wall. Backer face plates can be provided in different thicknesses to adjust the width of the wedge slots to accommodate blow bars of different thicknesses, and act as wear elements that can be periodically replaced instead of having to machine or rebuild the backer wall.

Therefore, it is a primary object of the present invention to provide an improved rotor assembly for a horizontal impact crusher which permits segmented blow bars to be mounted to the rotor assembly by means of a wedge mounting system. It is another object of the invention to provide an improved rotor assembly wherein the segmented blow bar and wedge elements interlock to provide a structurally sound wedge mounting arrangement that can withstand the rugged operating environment of the rotor assembly. It is a further object of the invention to provide a rotor assembly wherein the blow bars are easily replaced and wherein the need to inventory different sized blow bars is reduced or eliminated. Still another object of the invention is to reduce the need for machine maintenance and repair and associated down time. Other objects of the invention will become apparent from the following specification and claims, together with the accompanying drawings.

DETAILED DESCRIPTION OF THE ILLUSTRATED EMBODIMENT

Figure 1:
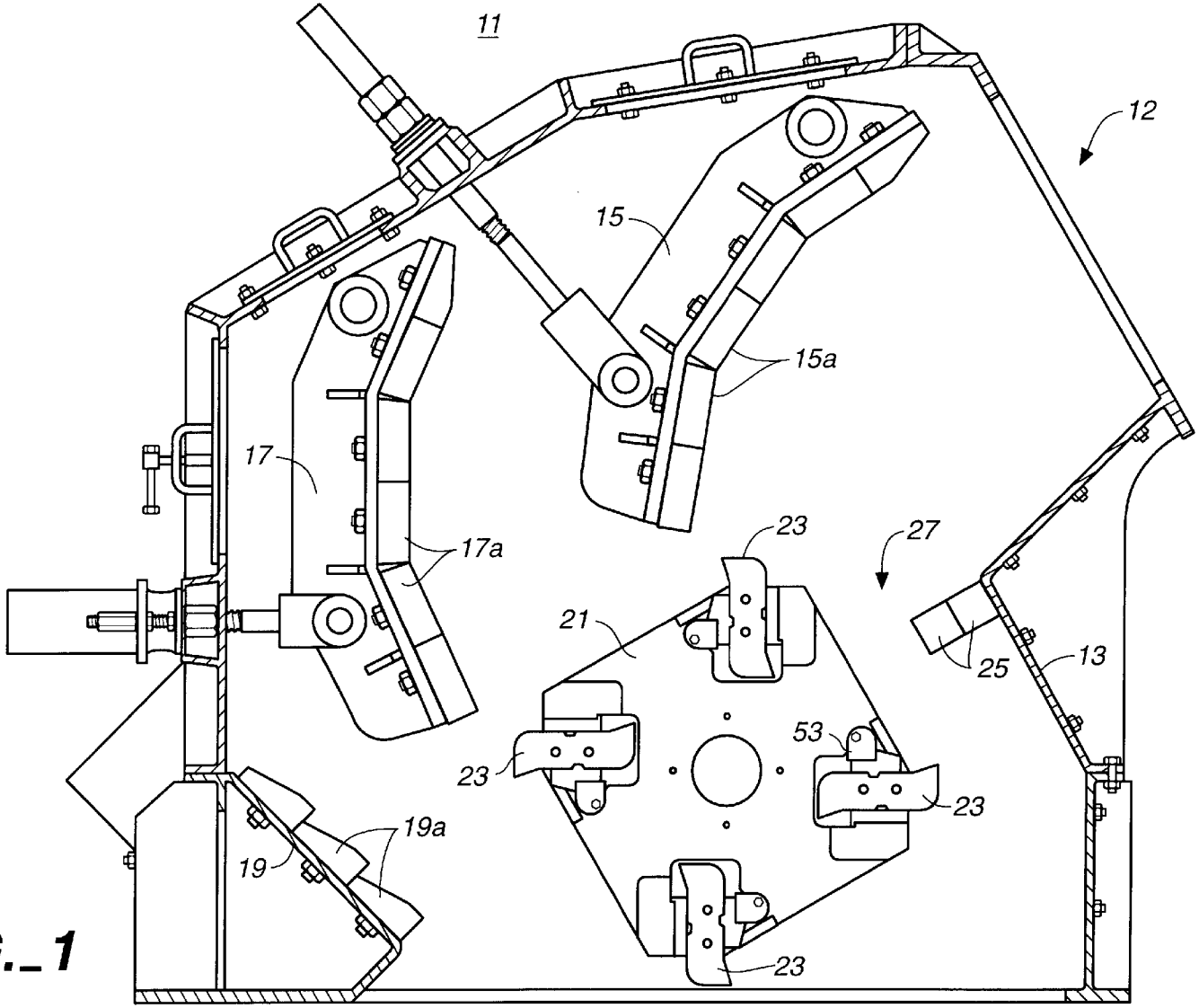
FIG. 1 is a cross-sectional view, in side elevation, of a horizontal impact crusher having an improved rotor assembly in accordance with the invention.

Referring now to the drawings, FIG. 1 shows the general configuration of a horizontal impact crusher, depicted by the numeral 11, wherein a crusher frame 13 houses hydraulically adjustable curtain assemblies 15, 17, a bottom stationary curtain assembly 19, and rotor assembly 21. In a manner well-known in the art, crushable material that is fed into crusher 11 through feed opening 12 is propelled against liner plates 15*a*, 17*a*, 19*a* of the adjustable and stationary curtain assemblies as the rotor assembly rotates at high speeds, such that, the impact of the crushable material striking the curtain assemblies generates the desired crushing forces. Stripper bars 25 provide a sized opening 27 between the rotor assembly 21 and the crusher frame 13 to insure that all material fed into the crusher is engaged by the rotor assembly.

Figure 2:
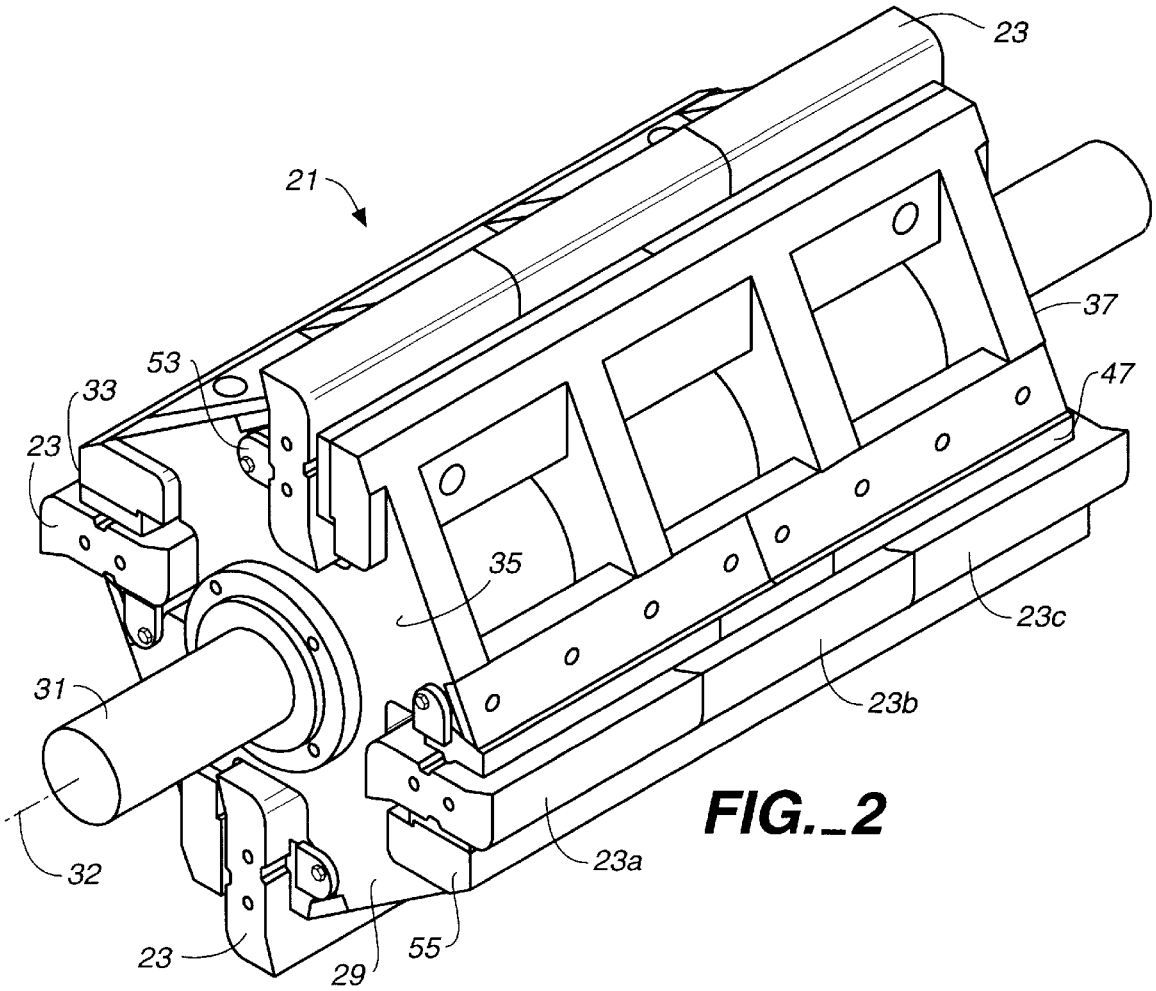
FIG. 2 is an enlarged top perspective view of the improved rotor assembly of the horizontal impact crusher shown in FIG. 1.

Referring to FIG. 2, the crusher's rotor assembly 21 is shown as having a rotor body 29 secured to drive shaft 31 which rotates about rotor axis 32, with the assembly's four floating blow bars 23 being mounted to the rotor body's outer perimeter 33 at equally spaced 90° intervals. It can be seen that the length of the rotor body along the rotor axis is generally defined by the rotor end walls 35, 37. It can also be seen that blow bars 23 provide a continuous floating blow bar structure that spans this entire length of the rotor, and in fact projects somewhat beyond the rotor end walls. The length of the blow bars are generally chosen to occupy the width of the housing frame 13 in order to prevent crushable material from falling through the ends of the rotor assembly.

Figure 3:
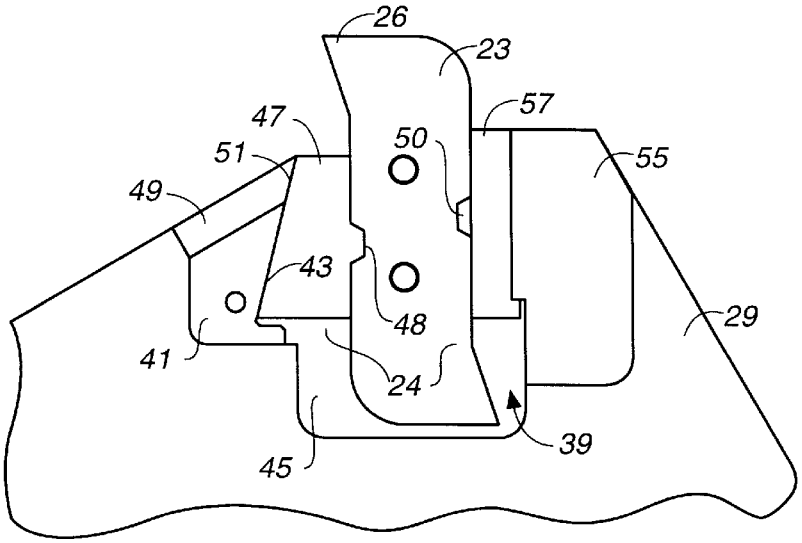
FIG. 3 is an enlarged fragmentary view, in side elevation, of the rotor assembly of FIG. 2, showing the wedge mounting of the blow bars in the perimeter of the rotor body.

Each blow bar 23 is comprised of three separate blow bar segments, 23*a*, 23*b*, 23*c*, which, as best shown in FIG. 3, are mounted in an end-to-end abutting relation in a generally V-shaped wedge slot 39 having a width that is greater than the thickness of the blow bar segments. A wedge shoe 41 is welded into the side of the wedge slot to provide a wedge seat 43 that slopes inwardly toward the outer perimeter of the rotor body. Replaceable wear plate 49 attached to the top of the wedge shoe extends wedge seat 43 and provides a serviceable wear surface for a floating wedge means.

Figure 4:
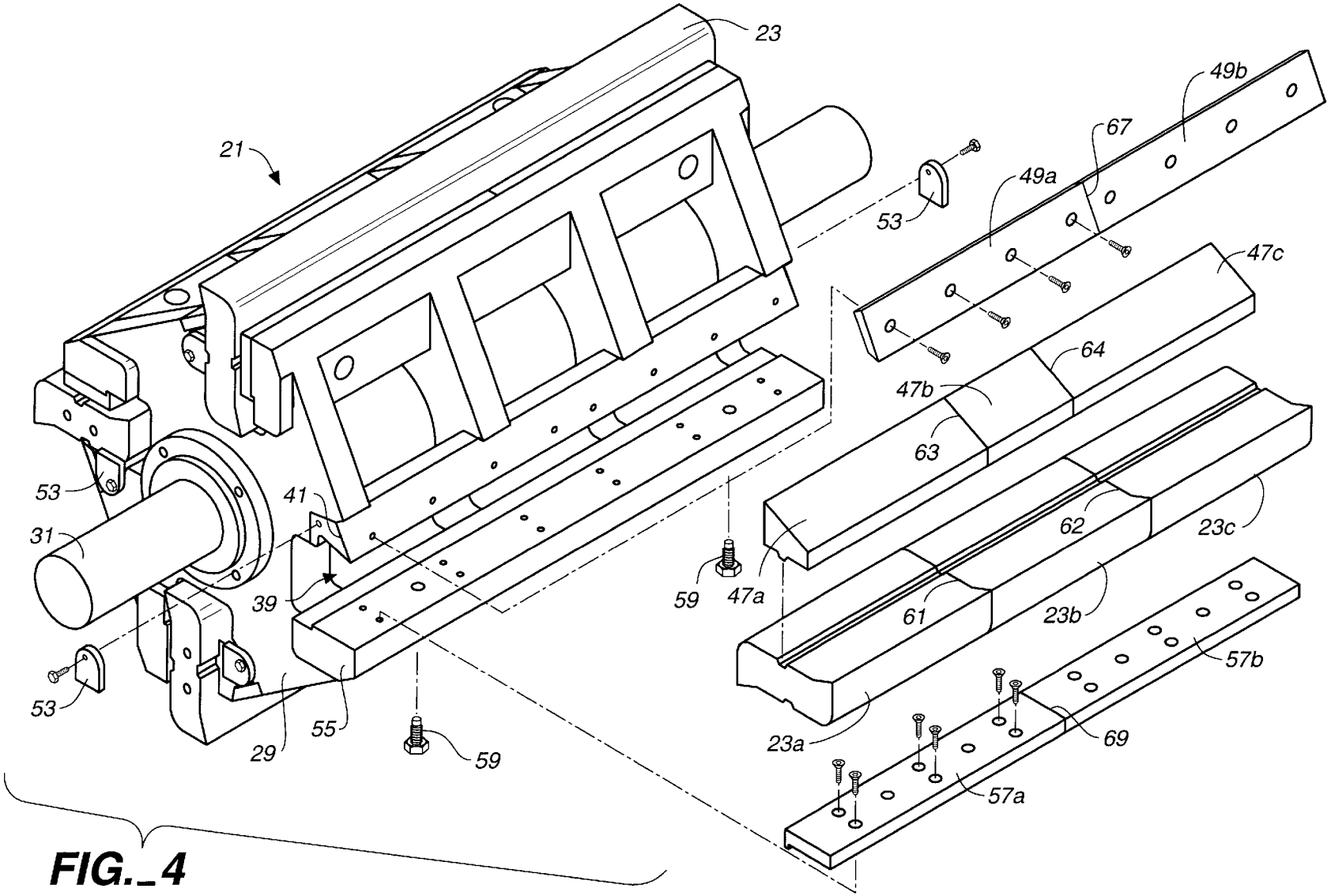
FIG. 4 is an exploded view of the rotor assembly of FIG. 2.
Figure 5:
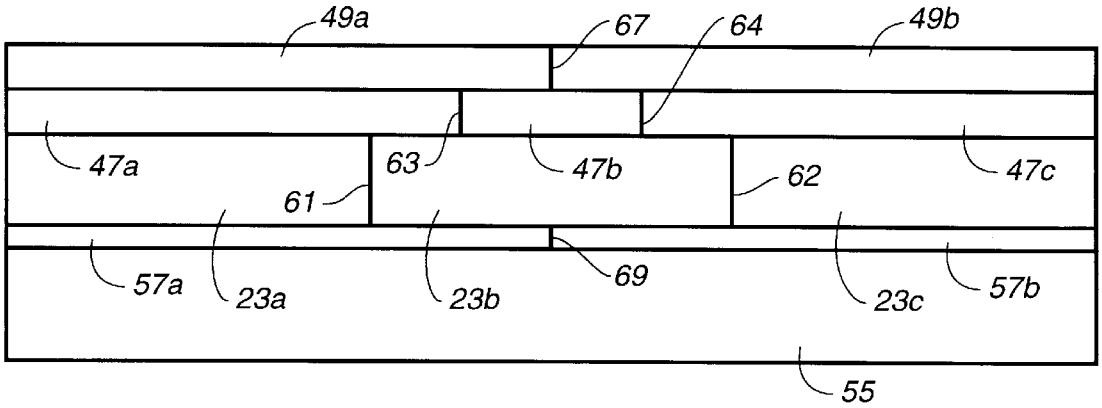
FIGS. 5 and 5A are graphical representations of the interlocking blow bar wedge system of the invention.

The assembly's wedge means, like the blow bars, are comprised of segmented elements, namely, floating wedge segments 47*a*, 47*b*, 47*c* (see FIGS. 2, 4, and 5). These wedge segments fit into the wedging space 45 of the wedge slot in end-to-end abutting relation, such that, a continuous wedge structure is provided which interlocks with the blow bar segments as described in greater detail below. End plates 53 removably attached at the edge of the wedge slots at each end of the rotor body hold the wedge and blow bar structure in place.

Each of the rotor's wedge slots also includes a backer wall 55 which opposes the slot's wedge seat 43. Backer wall face plates 57 removably attach to the backer wall by suitable screw attachments as shown in FIG. 4, and provide a means to size the wedge slot to accommodate blow bars of a given thickness. As noted above, the backer wall face plates also protect the backer wall eliminating the need for costly repair work in this region of high wear. FIG. 4 also shows the use of anti-shift pins 59 inserted through the backer wall to prevent lateral movement of the blow bar in the wedge slot when the crusher is operating.

Figure 5A:
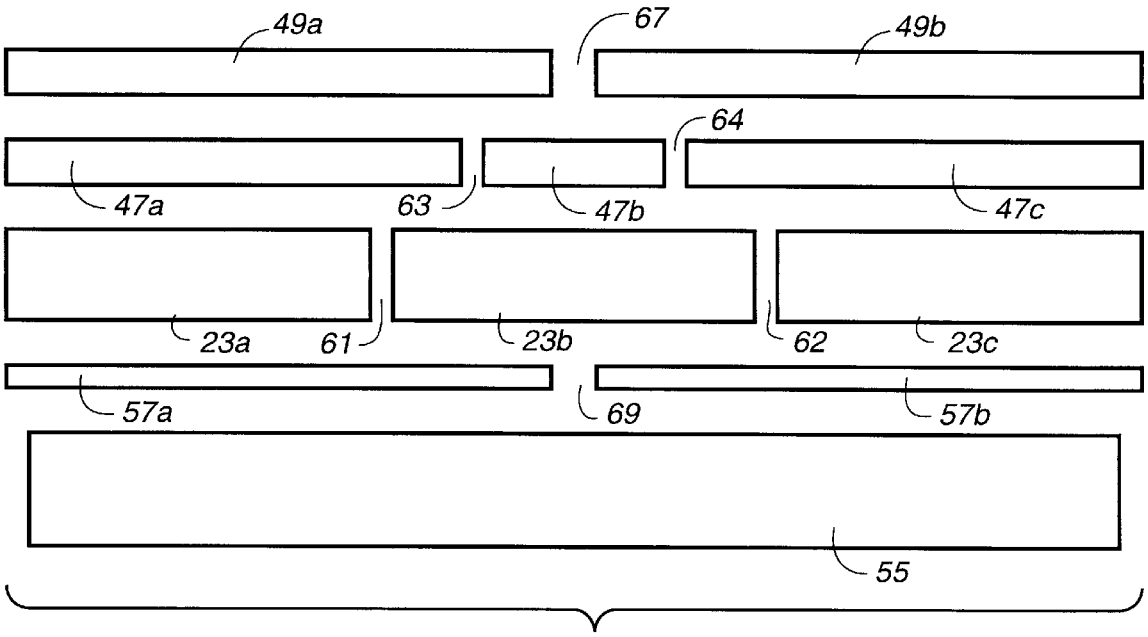

With reference to FIGS. 4 and 5, it can be seen that a blow bar wedge assembly 24 associated with each wedge slot is formed by interlocking elements which, for reasons of structural integrity, have no overlapping joints. Specifically, joints 61, 62 of blow bar segments 23*a*, 23*b*, 23*c* are laterally displaced from joints 63, 64 of wedge segments 47*a*, 47*b*, 47*c*. Similarly, the joint 67 of wedge wear plate segments 49*a*, 49*b* is positioned between wedge joints 63, 64, while joint 69 of backer wall face plate segments 57*a*, 57*b* is located between blow bar joints 61, 62. The overlapping joint structure of this blow bar wedge assembly is diagrammatically illustrated in FIGS. 5 and 5A which show a stack of segmented elements—plus backer wall 55 which is not segmented—with the segment joints of each element in the stack being located over the structure of one of the adjacent elements in the stack. The overlapping elements form an interlocking, highly durable structure that is easily assembled and disassembled.

Each blow bar wedge assembly 24 is easily assembled and disassembled in their respective wedge slots 39 as follows: To assemble the blow bar assembly, a backer face plate 57 of a suitable thickness to accommodate a desired blow bar is attached to the wedge slot's backer wall 55. The segments of blow bar 23 are then dropped into the wedge slot, after which the segments of wedge 47 are installed by sliding them into wedging space 45 from the end of the rotor. Finally, wear plate segments 49*a*, 49*b* are fastened to the top of the wedge shoe by suitable screw attachments as shown in FIG. 4, and end plates 53 secured at each end of the wedge slot to hold the resulting blow bar and wedge structure in place. It is noted that the blow bar is a symmetric element, thus when one of the blow bar tips 26 wears down, the blow bar can be reversed in the wedge slot to make use of the opposite tip. It is also noted that each blow bar 23 and its corresponding wedge 47 are locked together by means of a locking rib 48 on the back face of wedge which fits into a corresponding locking groove 50 machined into face of the blow bar.

The blow bar and wedge assembly above described is sized to fit loosely within the wedge slot until the rotor assembly is driven into rotation, whereupon centrifugal forces wedge the blow bar and wedge structure into place against wedge seat 53. To replace the blow bars, the blow bars simply need to be struck by a hammer or other suitable instrument to break the wedge assembly loose from the wedge seat. The end caps 53 can then be removed to permit the wedges to first be slid out of the wedge slot, after which the heavier blow bars can be lifted out.

Therefore, it can be seen that the present invention provides for an improved rotor assembly for a horizontal impact crusher which employs an improved wedging system for holding segmented blow bars onto the body of the rotor assembly. The invention provides a rotor assembly having a high degree of structural strength and which is easily assembled and disassembled for blow bar repair and replacement. While the invention has been described in considerable detail in the foregoing specification and accompanying drawings, it is understood that it is not intended that the invention be limited to such detail, except as necessitated by the following claims.

What we claim is:

1. An improved rotor assembly for a horizontal impact crusher comprising a rotor body having an outer perimeter, at least two axially directed radial wedge slots formed in the perimeter of said rotor body, said wedge slots having a wedge seat sloping inwardly in relation to the outer perimeter of said rotor body, and a backer wall opposed to said wedge seat, a floating blow bar removably inserted into each of said wedge slots between said wedge seat and said backer wall so as to permit radial movement of said blow bar in said wedge slot, each of said blow bars being comprised of at least two separable blow bar segments which endwise abut each other to form a blow bar joint when said blow bar segments are operatively inserted into one of said wedge slots, said blow bar segments having a thickness less than the width of said wedge slots to provide a wedging space between said blow bar and the wedge seat of said wedge slot, and elongated floating wedge means removably inserted in each of said wedge slots between said wedge seat and said floating blow bar wherein centrifugal forces imparted to said wedge means when said rotor assembly rotates cause said wedge means to wedge against the wedge seat of said wedge slots so as to wedge the blow bars in said wedge slots, said elongated wedge means providing a continuous wedge structure which overlaps said blow bar joint to structurally tie said blow bar segments together.

2. The improved rotor assembly of claim 1 wherein the wedge seat of each said wedge slot is a continuous wedge seat that extends substantially the length of said wedge slot, and wherein said elongated wedge means provide a continuous wedge structure that extends substantially the entire length of said wedge seat.

3. The improved rotor assembly of claim 1 wherein each of said blow bars has at least three separable blow bar segments forming at least two blow bar joints, and wherein said elongated wedge means overlaps both said blow bar joints to structurally tie said blow bar segments together.

4. The improved rotor assembly of claim 1 wherein said elongated wedged means are comprised of at least two separable wedge segments which endwise abut each other to form a wedge joint when operatively inserted into one of said wedge slots, and wherein said wedge joint is displaced relative to said blow bar joint.

5. The improved rotor assembly of claim 3 wherein said elongated wedge means is comprised of at least three separable wedge segments which endwise abut each other to form at least two wedge joints when operatively inserted into one of said wedge slots, and wherein said wedge joints are displaced relative to said blow bar joints.

6. The improved rotor assembly of claim 1 further comprising a replaceable backer wall face plate removably secured to the backer wall of said wedge slot between said backer wall and said blow bar.

7. The improved rotor assembly of claim 6 wherein said replaceable backer wall face plate is comprised of at least two replaceable plate segments which endwise abut each other to form a face plate joint displaced relative to said blow bar joints.

8. An improved rotor assembly for a horizontal impact crusher comprising a rotor body having rotor axis, an outer perimeter, and a defined length, at least two axially directed radial wedge slots in the perimeter of said rotor body which extend the entire length of said rotor body, said wedge slots having a continuous wedge seat extending substantially the length of said wedge slot and sloping inwardly in relation to the outer perimeter of said rotor body, and a backer wall opposed to said wedge surface, a floating blow bar removably inserted into each of said wedge slots between said wedge seat and backer wall so as to permit radial movement of said blow bar in said wedge slot, said blow bar extending substantially the entire length of said rotor body, each of said blow bars being comprised of at least two separable blow bar segments which endwise abut each other to form a blow bar joint when operatively inserted into one of said wedge slots, said blow bar segments having a thickness less than the width of said wedge slots to provide a wedging space between said blow bar and the wedge seat of said wedge slot, and elongated floating wedge means removably inserted in each of said wedge slots between said wedge seat and said floating blow bar wherein centrifugal forces imparted to said wedge means cause said wedge means to wedge against the continuous wedge seat of said wedge slots so as to wedge the blow bars in said wedge slots, said elongated wedge means providing a continuous wedge structure for the entire length of said rotor body which overlaps the blow bar joint to structurally tie said blow segments together.

9. The improved rotor assembly of claim 8 wherein said elongated wedge means are comprised of at least two separable wedge segments which endwise abut each other to form a wedge joint when operatively inserted into one of said wedge slots, and wherein said wedge joint is displaced relative to said blow bar joint.

10. The improved rotor assembly of claim 9 wherein said elongated wedge means is comprised of at least three separable wedge segments which endwise abut each other to form at least two wedge joints when operatively inserted into one of said wedge slots, and wherein said wedge joints are displaced relative to said blow bar joints.

11. The improved rotor assembly of claim 10 further comprising a replaceable backer wall face plate removably secured to the backer wall of said wedge slot between said backer wall and said blow bar.

12. The improved rotor assembly of claim 11 wherein said replaceable backer wall face plate is comprised of at least two replaceable plate segments which endwise abut each other to form a face plate joint displaced relative to said blow bar joints, whereby said blow bars, wedge means and backer wall face plate are all provided by continuous interlocking segmented elements.

13. An improved rotor assembly for a horizontal impact crusher comprising a rotor body having an outer perimeter, at least two axially directed radial wedge slots formed in the perimeter of said rotor body, said wedge slots having a wedge seat sloping inwardly in relation to the outer perimeter of said rotor body and a backer wall opposed to said wedge seat, a floating blow bar removably inserted into each of said wedge slots between said wedge seat and said backer wall so as to permit radial movement of said blow bar in said wedge slot, and an elongated floating wedge means removably inserted in each of said wedge slots between said wedge seat and said floating blow bar wherein centrifugal forces imparted to said wedge means when said rotor assembly rotates cause said wedge means to wedge against the wedge seat of said wedge slots so as to wedge the blow bars in said wedge slots.

14. The improved rotor assembly of claim 13 wherein the wedge seat of each said wedge slot is a continuous wedge seat that extends substantially the length of said wedge slot, and wherein said elongated wedge means provide a continuous wedge structure that extends substantially the entire length of said wedge seat.

15. The improved rotor assembly of claim 13 further comprising a replaceable backer wall face plate removably secured to the backer wall of said wedge slot between said backer wall and said blow bar.

16. The improved rotor assembly of claim 13 wherein said replaceable backer wall face plate is comprised of at least two replaceable plate segments.

17. The improved rotor assembly of claim 13 wherein said wedge seat is provided by a wedge shoe and a replaceable wear plate attached to said wedge shoe wherein said wear plate provides a replaceable wear surface for contacting said wedge means.

* * * * *